United States Patent [19]

Payne et al.

[11] 4,109,817

[45] Aug. 29, 1978

[54] STRAW ASSEMBLY FOR A LIQUID CONTAINER

[76] Inventors: Larry E. Payne, 3224 Wesley Chapel Rd., Decatur, Ga. 30034; Kenneth D. Lancaster, Jr., 965-C Clubhouse Cir., W., Decatur, Ga. 30032

[21] Appl. No.: 725,880

[22] Filed: Sep. 23, 1976

[51] Int. Cl.[2] ..... A47G 19/22

[52] U.S. Cl. ..... 220/90.2; 229/7 S

[58] Field of Search ..... 215/1 A; 222/464; 220/90.2; 229/7 S

[56] References Cited

U.S. PATENT DOCUMENTS

| | | | |
|---|---|---|---|
| 3,291,331 | 12/1966 | Grisham et al. | 215/1 A |
| 3,656,654 | 4/1972 | Brinkley | 215/1 A |

FOREIGN PATENT DOCUMENTS

| | | | |
|---|---|---|---|
| 1,307,693 | 9/1962 | France | 215/1 A |
| 1,015,430 | 12/1962 | United Kingdom | 215/1 A |

*Primary Examiner*—Stanley H. Tollberg

*Attorney, Agent, or Firm*—Newton, Hopkins & Ormsby

[57] ABSTRACT

A straw assembly for a liquid container having a pull-tab closure over an opening in its top. Removal of the closure allows the straw which is collapsed within the container and has a float mounted on its bottom end, to rise through the opening where it is manually extended to its full length. One embodiment includes the straw being slidably journaled within a tube mounted on the inner wall of the container. Another embodiment includes a straw guide assembly which positions the straw within the container in registry with an opening centrally disposed through the container top.

2 Claims, 11 Drawing Figures

STRAW ASSEMBLY FOR A LIQUID CONTAINER

BACKGROUND OF THE INVENTION

1. Field of the Invention

This invention relates to liquid dispensers and, more particularly, to straws for beverage containers.

2. Prior Art

Beverage containers in the form of metal cylindrical cans having a pull-tab closure are very familiar to consumers. It is sometimes desirable for the user to withdraw the liquid within the container through a straw. The reasons for this include the fact that it is more sanitary to drink from a straw rather than placing one's mouth over the opening in the can and also, that small children find it easier to drink through a straw than through the can opening.

There have been attempts in the past to provide a straw that is included within the container and can be utilized upon its opening. One type of such built-in straw is disclosed in Deaver, U.S. Pat. No. 3,542,278.

Prior art straws which were built into containers were cumbersome to use and were not always reliable in their operation.

SUMMARY OF THE INVENTION

The present invention which includes a straw for a beverage container of the type having a cylindrical body and a pull-tab closure over an opening in its top, the straw being collapsible and slidably journaled within a tube mounted on the wall of the container. The tube retains the straw in alignment with the container opening. The straw further includes a float mounted on the straw adjacent its bottom end and being exterior of the tube.

When the pull-tab closure is opened, the straw rises within the tube because of the float until the upper portion of the straw projects through the opening above the top. Further upward movement of the straw within the tube is prevented by the float. The straw is manually extended to its full length and the contents of the container are removed through the straw.

Another embodiment of the present invention includes a straw guide assembly which aligns the straw through a centrally disposed opening in the container top and which comprises a hollow guide tube which is vertically supported in registry with the opening by means of radially extending ribs which are connected to a ring disposed adjacent the interior wall of the container. The ring is provided with depending legs which supports the guide tube above the bottom of the container. Another ring and set of ribs further stabilize the guide tube adjacent its top. A collapsible straw is disposed within the guide tube with the bottom end of the straw extending below the guide tube and having an annular float mounted thereon, the diameter of the float being greater than the diameter of the guide tube.

A collapsible straw is disclosed having an inner section telescopingly received within an outer section, the outer section being journaled within the straw guide. The bottom of the inner section flares outwardly so as to contact the inwardly flared top of the outer section when the inner section is pulled upwardly and thus prevent the withdrawal of the inner section from the outer section.

It is an object of the present invention to provide a straw within a beverage container that has its upper portion automatically rise through a dispensing hole provided in the top of the container when the hole is opened.

DESCRIPTION OF THE PREFERRED EMBODIMENTS

Figure 1:
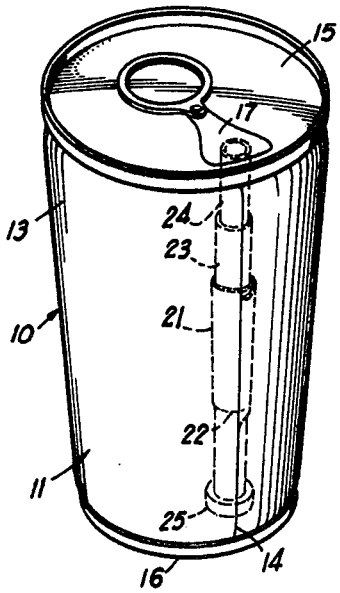
FIG. 1 is a perspective view of a beverage container with the first embodiment of the predent invention shown in phantom lines.
Figure 2:
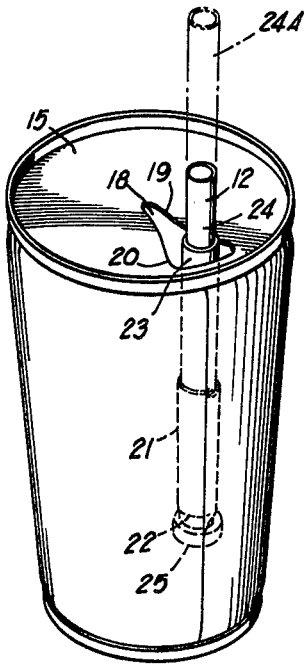
FIG. 2 is a perspective view of an opened beverage container showing the first embodiment in operation.
Figure 3:
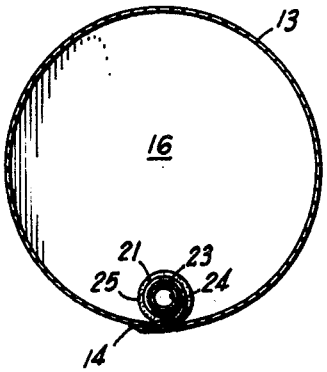
FIG. 3 is a cross-sectional top plan view of the first embodiment.

Referring now to the figures of drawing, FIGS. 1–3 disclose the first embodiment of the present invention 10 which includes a beverage container 11, straw 12 and a guide tube.

The beverage container 11 is generally the type utilized with carbonated or pressurized liquids and comprises a main cylindrical body 13 formed with a sheet of rolled aluminum or other type of suitable metal, the two ends of which overlap and are joined along exteriorally formed vertical seam 14 by any conventional means, such as welding. The container 11 includes a top 15 and bottom 16 which are secured in their respective positions by conventional means. A conventional pull-tab closure 17 is secured over opening 18 through top 15. As can be seen in FIG. 2, opening 18 comprises a narrow portion 19 which is adjacent the center of top 15 and which forms widened portion 20 as the opening 18 approaches the periphery of top 15.

The overlapped end of body 13 includes a projection 21 which extends within the interior of container 11 and is brought back onto itself so as to form the guide tube. The interior dimension of projection 21 is sufficient to slidably receive therein the straw 12, as will be described in detail hereinbelow. The projection 21 is centrally positioned within container 11 so as to leave a space between bottom 16 and the bottom edge 22 of projection 21.

The straw 12 is composed of at least two telescoping, hollow tubular sections, an outer section 23 slidably journaled within projection 21 and a section 24 which is slidably journaled within the outer section 23.

Bouyant means is provided on the straw 12 and comprises a float in the form of an annular ring 25 disposed about the outer periphery of section 23 adjacent its bottom end. The ring 25 is of a greater diameter than projection 21 and is constructed of any suitable bouyant material, such as styrofoam. The ring 25 may be sheathed in plastic to prevent its being separated or broken apart.

When the container 11 filled with liquid, the top of straw section 24 normally abuts the underside of closure 17 as seen in phantom lines FIG. 1. When closure 17 is removed, the float or ring 25 causes the outer straw section 23 to rise within the tube 13 through opening 18. The straw section 24 will automatically extend beyond top 15 to its position as shown in solid lines as shown in FIG. 2. The further upward movement of section 23 is limited by the top of ring 25 contacting the bottom 22 of guide 21. The straw section 24 can be extended to its operational or drinking position as shown in phantom lines as 24A by manually pulling upwards on section 24. When in its extended position, the straw 12 will be approximately the same length as a conventional drinking straw.

Figure 4:
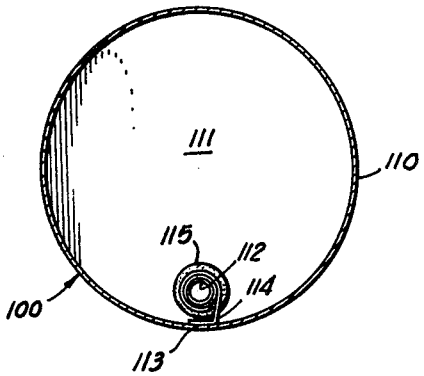
FIG. 4 is a cross-sectional top plan view of the second embodiment of the present invention.

In FIG. 4, the container 100 is comprised of a seamless cylindrical body 110 having a bottom 111 and a top, an opening therethrough and closure therefor as described above. The means for retaining the straw 112 in vertical alignment with the opening is a unitary element which is secured to the interior wall of body 110 by any suitable means along the rear surface of flat portion 113. The portion 113 is bent to form curved portion 114 which receives the straw 112 therethrough. The element may be constructed of plastic or any suitable metal. Secured to the bottom of straw 112 is an annular float 115. The operation of the straw 112 is the same as described above for straw 12.

Figure 5:
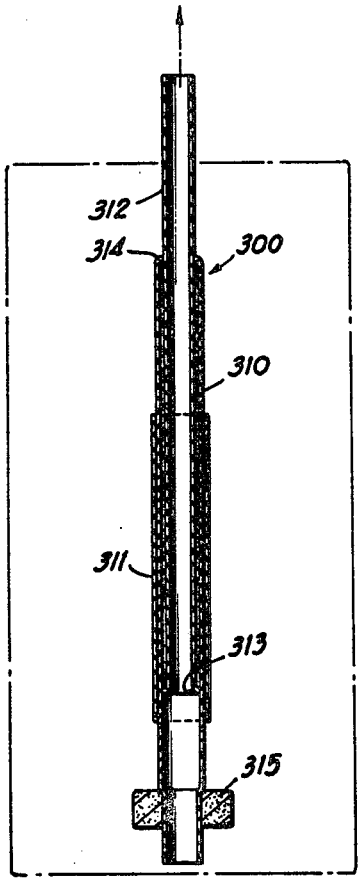
FIG. 5 is a cross-sectional side elevational view of the third embodiment of the present invention.

FIG. 5 shows embodiment of a telescoping straw 300 which may be utilized as straw 12 in the first embodiment. The straw 300 has an outer section 310 slidably journaled within guide tube 311. An inner section 312 is telescopingly received within section 310 and includes an outwardly flared annular bottom 313, the outer edges of which engage the interior of outer section 310. The top of section 310 is provided with an inwardly directed shoulder 314 which engages the outer surface of section 312. An annular shaped float 315 is secured about outer section 310 adjacent its bottom end, the float 315 having a greater exterior diameter than tube 311.

As section 312 is pulled upwardly to assume a drinking position, the bottom 313 contacts shoulder 314 to prevent the complete withdrawal of section 312 from section 310. As in the other above described embodiments, the float 315 engaging the bottom of tube 311 limits the upward travel of section 310.

Figure 6:
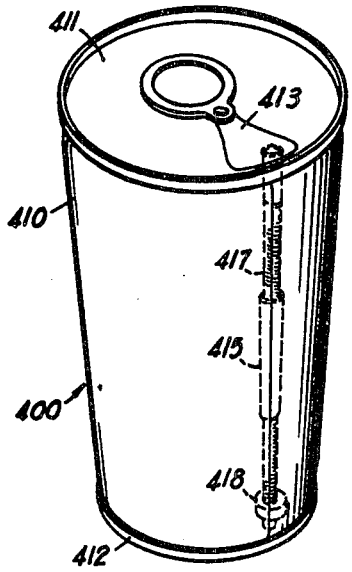
FIG. 6 is a perspective view of a closed beverage container showing the fourth embodiment of the present invention.
Figure 7:
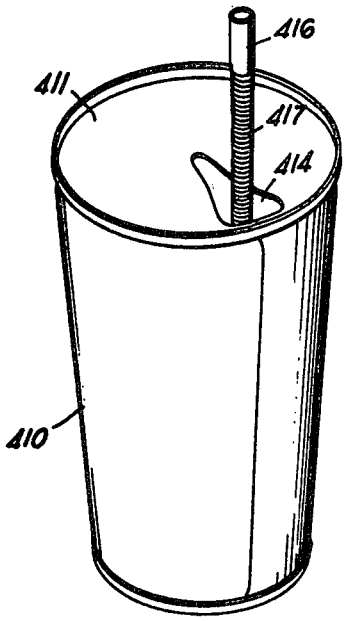
FIG. 7 is a perspective view of the beverage container showing the fourth embodiment in operation.
Figure 8:
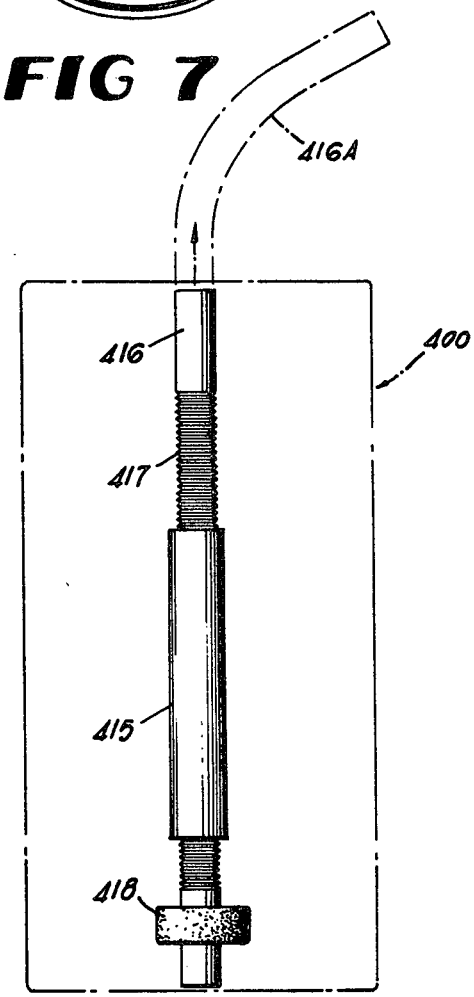
FIG. 8 is a side elevational view of the fourth embodiment of the present invention.

A further embodiment of the present invention is shown in FIGS. 6–8 wherein a container 400 has a cylindrical body 410, a top 411, bottom 412 and a conventional pull-tab closure 413 detachably secured over opening 414. A straw guide 415 is secured to the interior wall of body 410 and is a tubular element which is of dimensions to slidably receive a straw 416 therethrough.

Straw 416 is of a unitary construction and includes a collapsible portion intermediate its ends. The collapsible portion comprises an accordion pleated section 417. A ring 418 is secured to the exterior of the solid portion of straw 416 adjacent its bottom end and is constructed of any suitable bouyant material.

In its operation, the straw 416 assumes the compressed shape as shown in phantom lines in FIG. 6 and solid lines in FIG. 8 with the top of the straw 416 being in alignment with opening 414. When closure 413 is removed, the top of straw 416 rises through opening 414 as a result of the buoyancy of ring 418, until the top of ring 418 engages the bottom of straw guide 415. The straw 416 may then be manually extended by grasping its top and pulling upwardly to expand accordian pleated section 417. The extended or drinking position of straw 416 is shown in FIG. 7. Since the section 417 is flexible along its length, that portion of the straw 416 which extends beyond top 411 may be bent from the vertical to assume the position shown in FIG. 8 in phantom lines as 416A in order to aid in withdrawing the liquid from the container 400.

Figure 9:
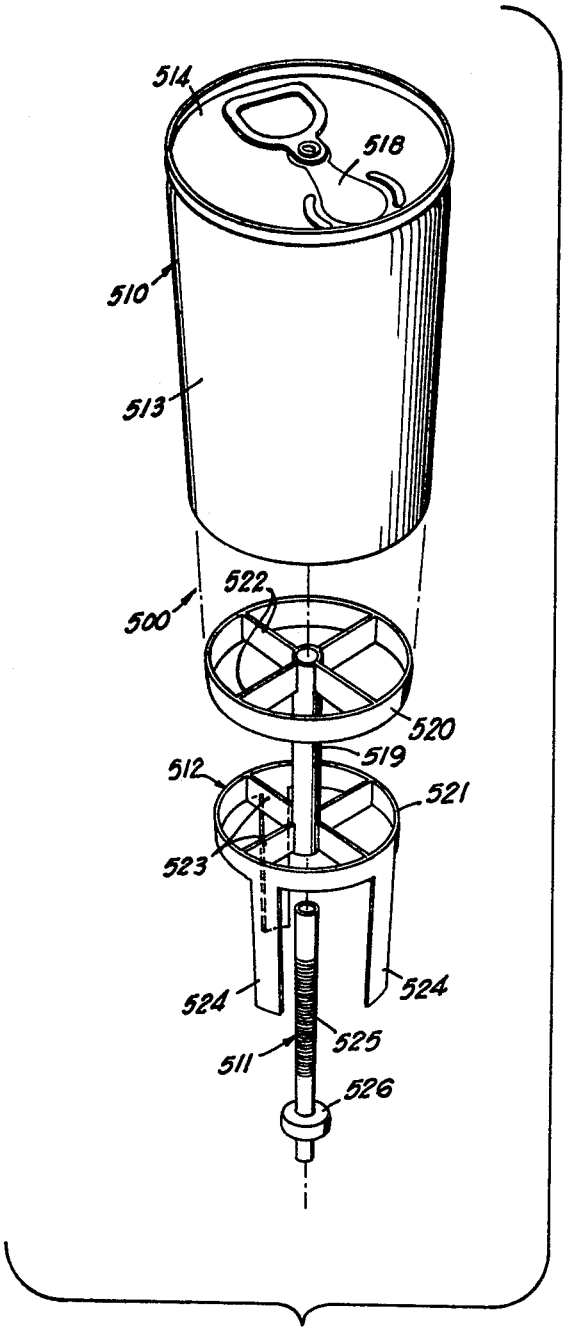
FIG. 9 is an exploded perspective view of the fifth embodiment of the present invention.
Figure 10:
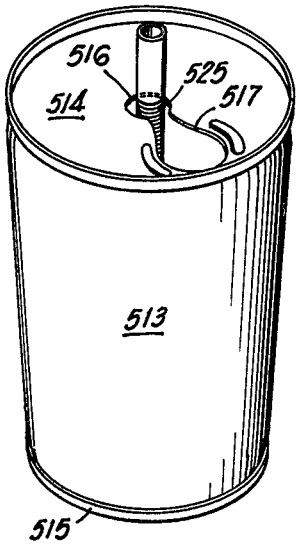
FIG. 10 is perspective view of the fifth embodiment of the present invention in operation.
Figure 11:
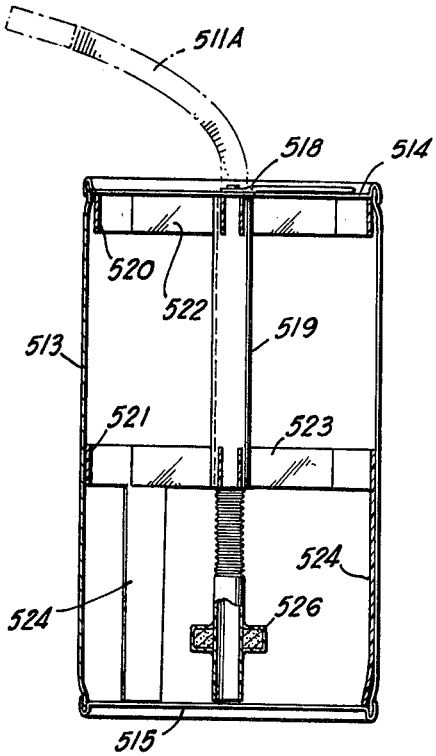
FIG. 11 is a cross-sectional side elevational view of the fifth embodiment of the present invention.

The final embodiment of the present invention is shown in FIGS. 9–11 as numeral 500 and comprises a container 510, a straw 511 and a straw guide assembly 512.

The container 510 comprises a round body portion 513 having a top 514 and bottom 515 secured at each of its ends. A circular opening 516 is centrally disposed through top 514 with one segment of opening 516 communicating with a bulbous shaped opening 517 which extends toward the outer periphery of top 514. A conventional pull-tab closure 518 is secured over openings 516, 517.

The straw guide assembly 512 comprises a hollow tube 519 which is in vertical registry with opening 516. Rings 520 and 521 are concentrically disposed about tube 519 adjacent its top and bottom, respectively. Radially extending ribs 522, 523 project inwardly from the interior surface of rings 520, 521, respectively, to support the tube 519 in its vertical attitude as shown in FIGS. 9 and 11. Legs 524 extend from the bottom of ring 521 in equally-spaced fashion to support the tube 519 above the bottom 515 of container 519. The outer dimensions of rings 520, 521 and legs 524 are such that they extend within the interior of container 510 adjacent the inner surface of body portion 513.

Straw 511 is slidably journaled within tube 519 and includes an accordion pleated section 525 intermediate its ends. The bottom portion of straw 511 extends below tube 519 and has an annular float 526 which encircles the outer surface of straw 511 adjacent its bottom end. The outer diameter of float 526 is greater than the diameter of tube 519.

The purpose of assembly 512 is to centrally position the tube 519, and thus straw 511, within container 510 in registry with opening 516. The assembly 512 is so constructed as to minimally interfere with the liquid level with container 510. The assembly 512 would displace an insignificant amount of liquid when it is inserted into the container 510.

The embodiment of the present invention which is depicted in FIGS. 9–11 operates in a fashion similar to the previously described embodiments. The assembled embodiment is shown in solid lines in FIG. 11 and when the closure 518 is removed, the straw 511 floats within the liquid in container 510 and emerges through opening 516 to the position as shown in FIG. 10 because of the contacting of the top of float 526 with the bottom of tube 519. The top of straw 511 is manually grasped and pulled upwardly so as to extend section 525. The float 526 prevents the straw 511 from being completely withdrawn through tube 519. The straw 511 may be bent through section 525 to assume the position 511A as shown in phantom lines in FIG. 11.

In all of the above described embodiments, the liquid in the containers may be withdrawn through the straws, but sufficient space is provided in the opening through the tops of the containers so that the liquid may be poured through the openings without any interference from the straws.

What we claim is:

1. A straw assembly within a liquid container having an interior wall surface, a flat top and a closure over an opening through said top, comprising (a) a collapsible straw for sucking up the liquid within said container;

(b) buoyant means on said straw; and (c) means secured on said interior wall surface of said container for retaining said straw within said container in alignment with said opening, said retaining means comprising a ring, means for supporting said ring above the bottom of said container, a hollow post concentrically disposed through said ring and being of sufficient diameter to slidably receive said straw therein and at least two radially extending ribs interconnecting said ring and post to support said post in vertical registry with said opening.

2. A straw assembly for a liquid container of the type having a pull-tab closure over an opening in the top of the container and having a body formed of a cylindrical sheet of material having its ends joined in overlapping relationship, comprising:

(a) a collapsible straw;

(b) buoyant means secured on said straw adjacent its bottom end; and (c) means for retaining said straw within said container in alignment with said opening, said retaining means comprising the overlapped end of said body being provided with a projection which is shaped to be of sufficient dimensions to slidably receive said straw therethrough.

* * * * *